US012345111B1

(12) United States Patent
Mishra et al.

(10) Patent No.: US 12,345,111 B1
(45) Date of Patent: Jul. 1, 2025

(54) ROTATING CHECK VALVE FOR IMPROVED DOWNHOLE OPERATIONS

(71) Applicant: Schlumberger Technology Corporation, Sugar Land, TX (US)

(72) Inventors: Rishi Mishra, Sugar Land, TX (US); Dan Tabalan, Sugar Land, TX (US)

(73) Assignee: SCHLUMBERGER TECHNOLOGY CORPORATION

( * ) Notice: Subject to any disclaimer, the term of this patent is extended or adjusted under 35 U.S.C. 154(b) by 0 days.

(21) Appl. No.: 18/441,239

(22) Filed: Feb. 14, 2024

(51) Int. Cl.
*E21B 27/00* (2006.01)
*E21B 34/06* (2006.01)

(52) U.S. Cl.
CPC ..... *E21B 27/00* (2013.01); *E21B 34/06* (2013.01)

(58) Field of Classification Search
CPC ..... E21B 27/00; E21B 34/06
See application file for complete search history.

(56) References Cited

U.S. PATENT DOCUMENTS 1,385,760 A * 7/1921 Swartz ..... E21B 27/00 166/167
2,182,374 A * 12/1939 Dumble ..... E21B 25/00 166/107
4,190,113 A 2/1980 Harrison
4,711,299 A 12/1987 Caldwell
5,139,089 A 8/1992 Wacker
7,478,687 B2 1/2009 Lynde
7,610,957 B2 11/2009 Davis
8,453,724 B2 6/2013 Zhou
10,526,845 B2 1/2020 Grabæk
10,704,351 B2 7/2020 Haugland
10,767,447 B2 9/2020 Kartha
10,858,900 B2 12/2020 Haugland
11,111,748 B2 9/2021 Mahajan
11,125,033 B2 9/2021 Edvardsen
11,319,763 B2 5/2022 Haugland
(Continued)

FOREIGN PATENT DOCUMENTS

CA 2881297 C 8/2017
DK 180023 B1 1/2020
(Continued)

OTHER PUBLICATIONS

Extended Search Report issued in European Patent Application No. IS22.0938-EP-EPA dated Apr. 8, 2025, 9 pages.

*Primary Examiner* — James G Sayre
(74) *Attorney, Agent, or Firm* — Ashley Brown

(57) ABSTRACT

A rotating check valve is disclosed for improved debris collection within a wellbore. The check valve can be part of a debris removal tool that includes a motor, pump, gearbox, bailer, milling bit, the check valve, rotational shafts. On its uphole end, the check valve can be coupled with the bailer such that the check valve can rotate relative to the bailer. Also on the uphole end, the check valve can be rotationally coupled to a shaft that passes through the bailer and couples with the gearbox. On the downhole end, the check valve can be rotationally coupled to the milling bit. The check valve can include a torque transfer mechanism that transfers torque generated by the motor and gearbox to the milling bit. The check valve can include a unidirectional flow control mechanism that restricts the flow of fluid and debris to the uphole direction.

17 Claims, 5 Drawing Sheets

(56) References Cited

U.S. PATENT DOCUMENTS

| | | | |
|---|---|---|---|
| 11,708,746 | B1 | 7/2023 | Xiao |
| 11,795,773 | B2 | 10/2023 | Garcia |
| 11,802,463 | B2 | 10/2023 | Haugland |
| 2009/0279966 | A1 | 11/2009 | Blair |
| 2012/0118571 | A1 | 5/2012 | Zhou |
| 2014/0262299 | A1 | 9/2014 | Tinnen |
| 2018/0029869 | A1 | 2/2018 | Carapelli |
| 2019/0316443 | A1 | 10/2019 | Haugland |
| 2020/0102809 | A1 | 4/2020 | Schindler |
| 2020/0300049 | A1 | 9/2020 | Edvardsen |
| 2024/0418050 | A1 | 12/2024 | Sheiretov |

FOREIGN PATENT DOCUMENTS

| | | | | |
|---|---|---|---|---|
| EP | 2458134 | A2 | 5/2012 | |
| EP | 2516793 | A2 | 10/2012 | |
| EP | 4222348 | A1 | 8/2023 | |
| NO | 342058 | B1 | 3/2018 | |
| WO | 2020122732 | A1 | 6/2020 | |
| WO | 2021226214 | A1 | 11/2021 | |
| WO | WO-2023183577 | A1 * | 9/2023 | ..... E21B 37/00 |

* cited by examiner

ROTATING CHECK VALVE FOR IMPROVED DOWNHOLE OPERATIONS

BACKGROUND

Field

The present disclosure generally relates to a downhole tool, and more particularly to methods and apparatus for loosening and collecting wellbore debris.

Description of the Related Art

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. Often debris needs to be removed from the wellbore after it is drilled. Wellbore debris can include sand, scale, metallic junk, proppant, and other solids that may be mixed with pipe dope or asphaltenes. One of the challenges in designing a tool for removing debris is to provide a means to retain collected debris inside the collection chambers while the tool is being retrieved from the well.

SUMMARY

Systems, methods, and an apparatus are disclosed herein for an improved check valve for downhole operations within a wellbore. The function of the rotating check valve is to allow the flow of fluid in one direction (downhole to uphole) while simultaneously transferring mechanical energy from a shaft uphole to a milling bit downhole. The check valve can be part of a downhole drilling assembly that can simultaneously mill and filter debris in a wellbore. Such a downhole assembly can include various components, such a motor, a pump, a gearbox, a bailer with filters, the check valve, and a milling bit. The gearbox can modify the rotational speed and torque generated by the motor so that the motor can drive the pump and milling bit at different speeds and torques. The pump can create a suction force that pulls the drilling fluid and debris into the downhole assembly through the milling bit and the check valve. The filters in the bailer can capture the debris, and clean fluid can return to the pump where it is again pumped into the wellbore.

An embodiment of the rotating check valve can include an adapter that connects the check valve to the bailer uphole. A rotating shaft can be rotationally coupled to internal components of the check valve, thereby allowing the check valve to rotate with the rotating shaft. The check valve can include a securing mechanism that securely coupled the check valve with the milling bit. The check valve can also include a torque transfer mechanism that transfers the torque from the check valve to the milling bit. The torque transfer mechanism can be a protrusion of a geometric shape of more than two sides for which the milling bit has a matching cavity that the protrusion sits in. As an example, the torque transfer mechanism can be a hexagonal protrusion that sits in a hexagonal cavity of the milling bit. The torque transfer mechanism can include a lumen (inner cavity) that allows for fluid and debris to pass through into the bailer.

The check valve can include a flow control ball located at the base of the torque transfer mechanism. The flow control ball can have a larger diameter than the lumen so that the flow control ball cannot enter the lumen. When fluid attempts to leave the drilling assembly in the downhole direction, force created by the water can cause the flow control ball to be seated at the base of the lumen of the torque transfer mechanism, creating a seal that blocks water from escaping through the milling bit. When the pump is activated, the fluid is pulled through the milling bit and into the check valve. Force created by the fluid pushes the flow control ball away from the lumen so that the fluid and debris can pass through the check valve in the uphole direction.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
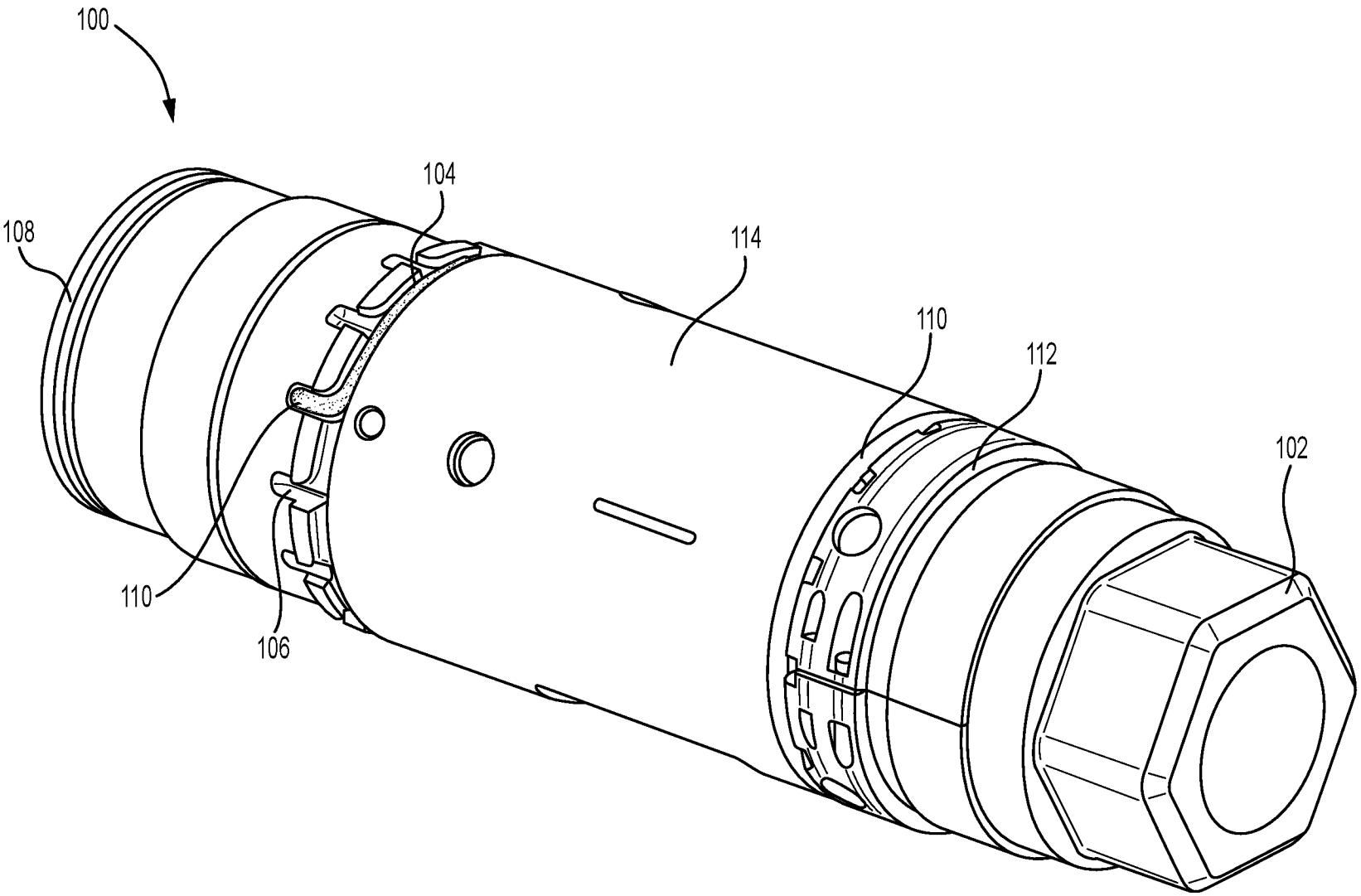
FIG. 1 an illustration of a perspective view of a rotating check valve.

FIG. 1 an illustration of a perspective view of a rotating check valve 100 (referred to interchangeably as the "check valve 100"). The function of the rotating check valve 100 is to allow the flow of fluid in one direction (downhole to uphole) while simultaneously transferring mechanical energy from the shaft uphole to a milling bit connected to the check valve 100. The check valve 100 can include a bailer adapter 114 that connects the check valve 100 to a bailer (described later herein) on the uphole end of the check valve 100. The check valve 100 can include an O-ring 108 that seals wellbore fluid at the point where the check valve 100 connects with the bailer. In one example, the bailer adapter 114 can be a coupling mechanism that allows the check valve 100 to rotate relative to the bailer.

The check valve 100 can include a lock ring 104. The lock ring 104 can include a notch-engaging element 110 that securely engages with a notch 106 in the bailer adapter 114. The lock ring 104 can lock rotation of the bailer adapter 114 to any component it connects to. As an example, in one embodiment a rotating shaft can pass through the bailer and connect to the check valve 100, and the lock ring 104 can lock the check valve 100 in rotation with the rotating shaft. In another embodiment, the bailer adapter 114 can connect directly to the bailer using the lock ring 104, and the bailer can rotate with the check valve 100. Although the check valve 100 is depicted as using a lock ring 104 to lock rotation of the check valve 100 with an uphole component, any type of coupling can be used that secures the check valve to an uphole component.

The rotating check valve 100 can include a coupling mechanism 112 that couples the check valve 100 with a milling bit. The coupling mechanism 112 can include any kind of engagement mechanism that keeps the check valve 100 securely connected to a milling bit, such as a threaded ring or a split threaded ring.

The downhole end of the check valve 100 can include a torque transfer mechanism 102 that transfers the torque from the check valve 100 to the milling bit. The torque transfer mechanism 102 can include a lumen 116 (inner cavity) that drilling fluid can pass through. The torque transfer mechanism 102 can be any shape or mechanism with a lumen that can both transfer torque to and allow for fluid transfer from the milling bit. For example, as shown in FIG. 1, the torque transfer mechanism 102 can be a hexagonal shape, and the milling bit can have a complementary hexagonal cavity that the torque transfer mechanism 102 nests inside of. Although a hexagonal torque transfer mechanism 102 is illustrated, other shapes are possible, such as a square, pentagon, or octagon.

Figure 2:
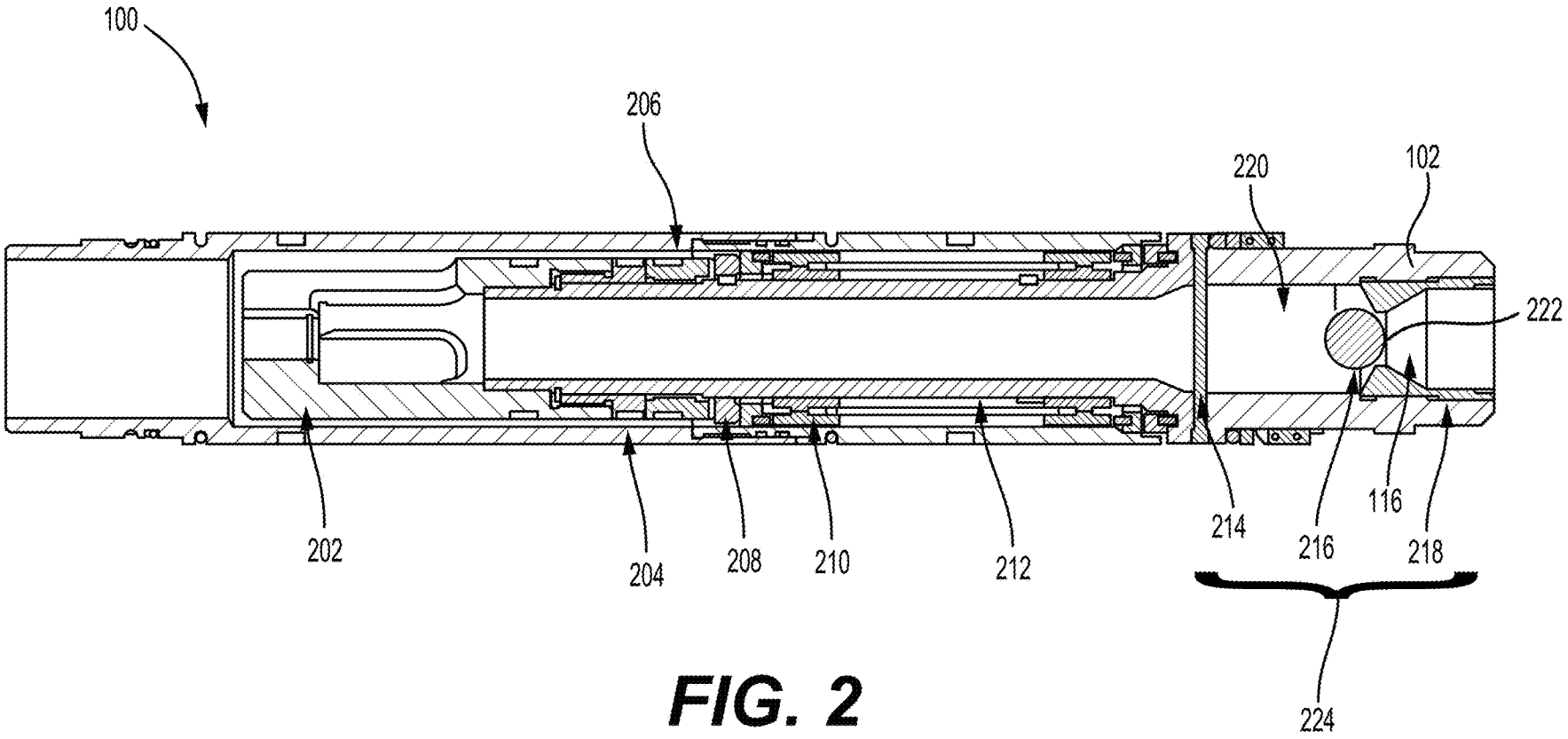
FIG. 2 an illustration of a cross-section view of the rotating check valve.

FIG. 2 an illustration of a cross-section view of the check valve 100 that depicts some internal components of the check valve 100. The check valve 100 can include a flow through nut 202. The flow through nut 202 can include splines to which an uphole shaft from the bailer can connect. The flow through nut 202 is connected to the torque transfer mechanism 102 through a threaded ring 204 and hex feature. As the uphole shaft rotates, the rotation is transferred to the milling bit via the torque transfer mechanism 102.

The check valve 100 can include a thrust bearing 208 and a radial bearing 210. The thrust bearing 208 can take the thrust load during milling, and the radial bearing can take the radial load during milling. A preload nut 206 can provide preload (tension created in a fastener when it is tightened) to the thrust bearing 208 and radial bearing 210. The check valve 100 can include a spacer 212 that keeps the bearings 208, 210 in their correct places inside the check valve housing.

At the uphole end of the torque transfer mechanism 102, a flow control ball 216 can be situated inside of a chamber 220 that includes a flow control seating 218 and a barrier 214. The chamber 220, flow control ball 216, and flow control seating 218 make up a unidirectional flow control mechanism. For example, When fluid enters the check valve 100, force exerted by the fluid displaces the flow control ball 216, allowing the fluid to pass through the chamber 220 and into the check valve 100. The uphole end of the chamber 220 can include a barrier 214 that prevents the flow control ball 216 from moving further into the check valve 100. The structure of the barrier 214 can block the flow control ball 216 but allow for the passage of fluids and drilling debris that is smaller than the flow control ball 216. The distance between the barrier 214 and the flow control seating 218 can be greater than the diameter of the flow control ball 216. The diameter of the flow control ball 216 can be less than the diameter of the chamber 220. This allows drilling fluid, when entering the check valve 100, to push the flow control ball 216 away from the flow control seating 218 and pass around the flow control ball 216. Conversely, when fluid begins to exit the check valve 100, the fluid propels the flow control ball 216 towards a flow control seating 218. For example, the flow control seating 218 includes an opening 222 for fluid passage. Notably, the diameter of the opening 222 is smaller than that of the flow control ball 216. In instances where water escapes downhole, the fluid pushes the flow control ball 216 against the opening 220 so that the flow control ball 216 acts as a plug, restricting further fluid flow.

Figure 3:
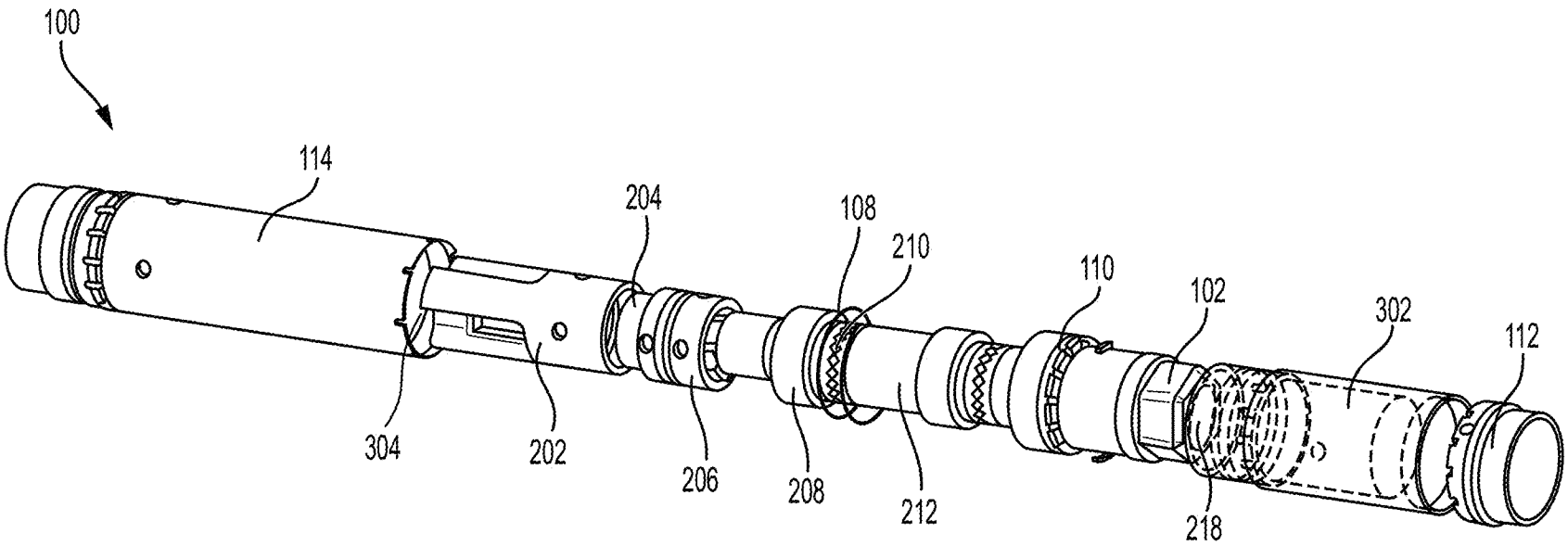
FIG. 3 an illustration of an exploded view of the rotating check valve.

FIG. 3 an illustration of an exploded view of the check valve 100 and includes the components previously described in FIGS. 1 and 2. FIG. 3 also illustrates the splines 304 of the flow through nut 202 that an uphole shaft from a bailer can connect to in order to rotationally drive the rotating check valve 100. Also shown is a housing 302 that can house the internal components of the check valve 100. In one embodiment, the housing 302 can be nested inside the bailer adapter 114. In an alternative embodiment, the housing 302 can be coupled with the bailer adapter 114 and extend downhole from the bailer adapter 114. FIG. 3 also depicts the bearings 204 and 210 radially displaced from their respective axial positions in the check valve 100.

Figure 4:
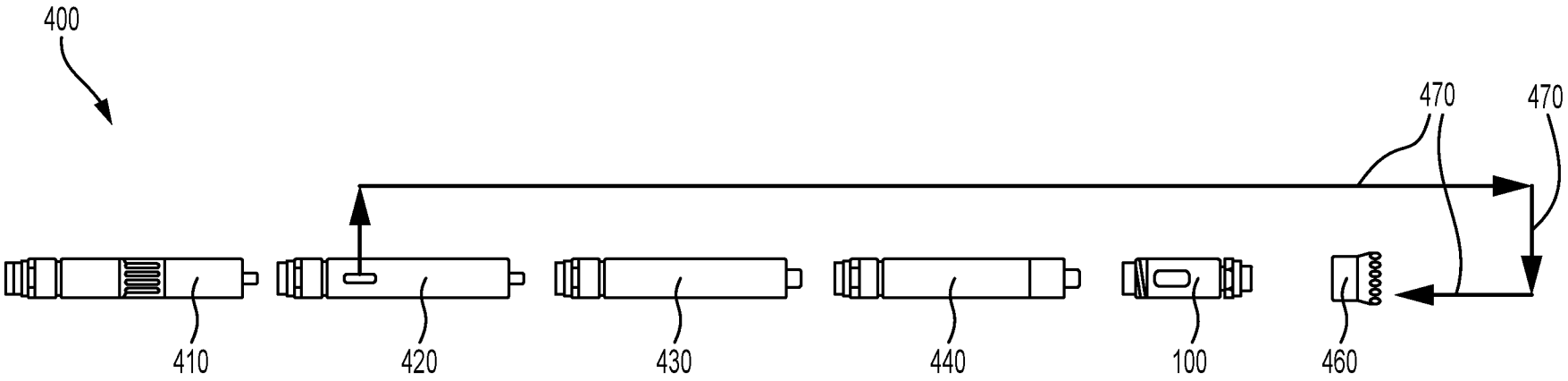
FIG. 4 depicts a schematic of downhole assembly for debris removal.

FIG. 4 shows a schematic of an example debris removal assembly 400 that includes the rotating check valve 100, according to an embodiment of the disclosure. The debris removal tool 400 includes an ADRM 410, a pump 420, a gear box 430, a bailer 440, the check valve 100, and a milling bit 460. When positioned inside a wellbore, the ADRM 410 is at the uphole end and the milling bit 460 is at the downhole end. The ADRM 410 includes subcomponents that drive the various components of the debris removal assembly 400. The ADRM 410 can drive the pump 420, which forces drilling fluid out of the d debris removal assembly 400 and into a cavity of the wellbore. The drilling fluid can be any fluid used in drilling operations, such as a fluid-based mud that includes fluid, clays, polymers, and additives; an oil-based mud that includes mineral oil or synthetic oil, clays, and various additives; a synthetic-based mud that includes synthetic oils and additives; a brine-based mud that includes fluid with high salt content (brine) and additives; or a polymer drilling fluid that includes fluid with added polymers.

The drilling fluid can be pulled back into the downhole assembly through the milling bit 460, as indicated by the arrows 470. The milling bit 460 can be any kind of flow-through bit that allows fluids and debris to pass through it into the debris removal assembly 400. The milling bit 460 can break up rock formations, which results in debris. The pump 420 can create a suction force that pulls the drilling fluid and debris into the debris removal assembly 400 through the milling bit 460 and the check valve 100, and into the bailer 440. For reasons described previously herein, the check valve 100 can restrict flow of the drilling fluid to the uphole direction and can rotate with the milling bit 460.

The bailer 440 can include filters (not shown), that catch debris pulled into the debris removal assembly 400. Clean fluid then continues through the gear box 430 and back into the pump 420 where it is then pumped back into the wellbore area. The gearbox 430 can include gears, bearings, and other subcomponents that modify the speed and torque generated by the motor. The downhole end of the gearbox 430 can be rotationally coupled to a shaft that passes through the bailer 440 and rotationally coupled with the uphole end of the check valve 100. This allows the motor to simultaneously drive the pump 420 and check valve 100 (and, consequently, the milling bit 160) at different speeds and torques. This in turn allows the downhole assembly to drill obstructions in the wellbore while simultaneously pulling in and filtering debris created by the drilling.

Figure 5:
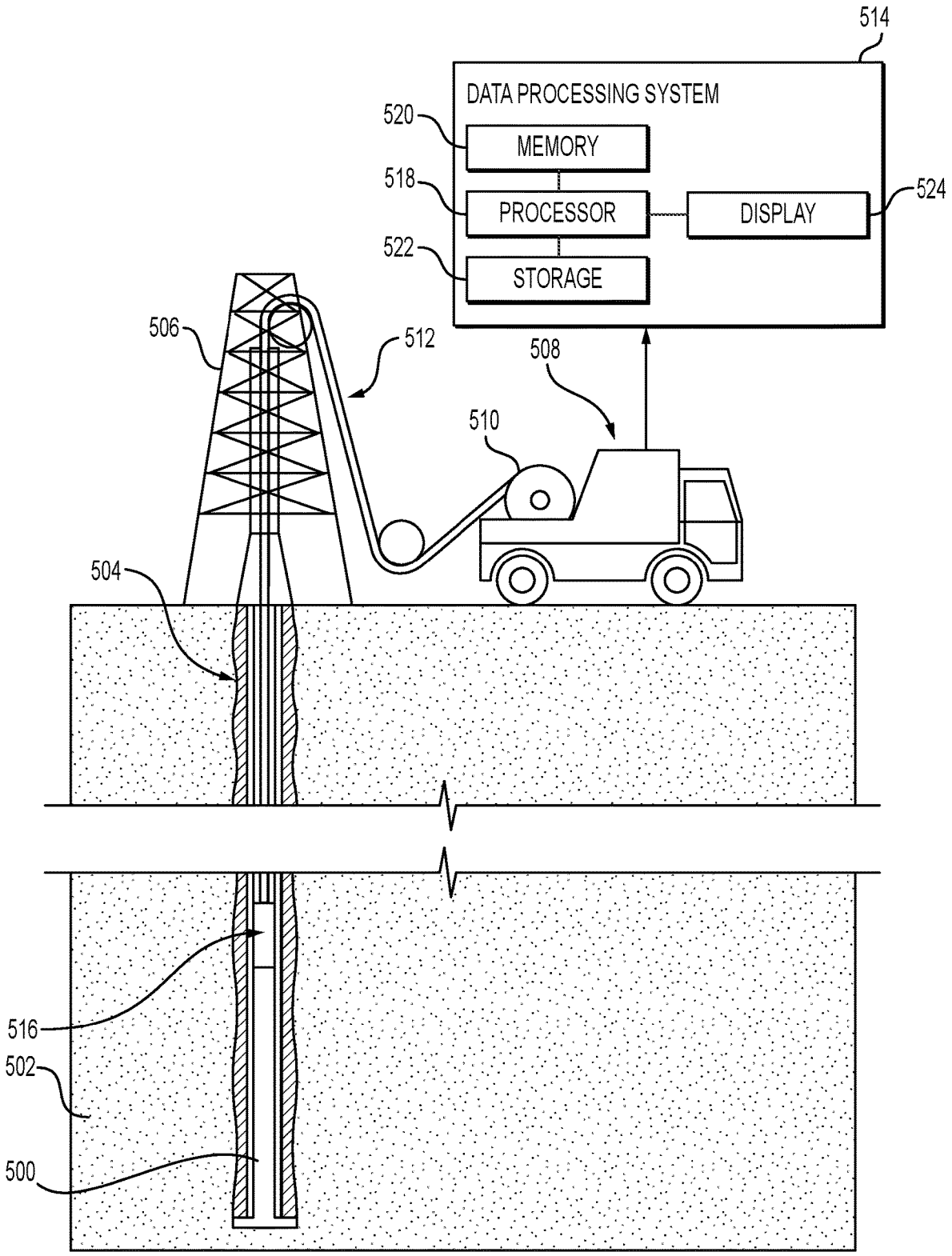
FIG. 5 depicts an exemplary well site where the present invention can be utilized.

FIG. 5 shows an exemplary well site where the present invention can be utilized. A formation 502 has a drilled and completed wellbore 504. A derrick 506 above ground may be used to raise and lower a debris removal assembly (e.g., the debris removal assembly 400 with the check valve 100) into the wellbore 504 and otherwise assist with well operations.

A wireline surface system 508 at the ground level includes a wireline logging unit, a wireline depth control system 510 having a cable 512, and a control unit 514. The cable is connected to a connection assembly 516 that may be lowered downhole. The control unit 514 includes a processor 518, memory 520, storage 522, and display 524 that may be used to display and control various operations of the wireline surface system 508, send and receive data, and store data.

The connection assembly 516 includes equipment for mechanically and electronically connecting the debris removal tool with the cable 512. The cable 512 includes a support wire, such as steel, to mechanically support the weight of the debris removal tool and communication wire to pass communications between the debris removal tool and the wireline surface system 508. The debris removal tool, as described in more detail below, is installed below the connection assembly.

The wireline surface system 508 can deploy the cable 512, which in turn lowers the connection assembly 516 and debris removal tool deeper downhole. Conversely, the wireline surface system 508 can retract the cable 512 and raise the debris removal tool and assembly, including to the surface. The cable 512 is deployed or retracted by the wireline depth control system 510, such as by unwinding or winding the cable 512 around a spool that is driven by a motor.

The wireline logging unit communicates with the control unit 514 to send and receive data and control signals. For example, the wireline logging unit can communicate data received from the debris removal tool to the control unit 514. The wireline logging unit likewise can communicate data and control signals received from the electronic control system 514 to the debris removal tool. In some examples, the wireline logging unit is part of the control unit 514. In other examples, the control unit 514 sends and receives data to and from the debris removal tool directly.

Although FIG. 5 shows the debris removal tool being operated on a cable 512, the debris removal tool can be attached to other types of conveyance systems, such as coil tubing. Any conveyance system can be used to mechanically support the debris removal tool and mechanically raise or lower it within the wellbore 504. References to a "cable" are intended to be non-limiting, instead encompassing any known conveyance system.

In some embodiments, the shaft is fixed in the axial direction and results in axial motion of the housing. These embodiments may include ones where there is a separate concentric housing around the main housing which extends relative to the end of the main housing to accomplish a similar radial, axial, or helical debris stop.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A check valve for debris collection within a wellbore, comprising:

a first coupling mechanism for coupling the check valve with an uphole bailer;

a torque transfer mechanism that applies rotational torque to a rotating milling bit, wherein the torque transfer mechanism includes a geometric protrusion with more than two sides and the rotating milling bit includes a cavity that matches the geometric protrusion such that the geometric protrusion can be seated in the cavity;

a second coupling mechanism for coupling the check valve with the rotating milling bit;

a lumen extending an axial length of the check valve; and a unidirectional flow control mechanism within the lumen that restricts fluid flow to an uphole direction.

2. The check valve of claim 1, wherein the first coupling mechanism allows the check valve to rotate relative to the uphole bailer.

3. The check valve of claim 1, wherein the unidirectional flow control mechanism comprises:

a chamber positioned within the lumen;

a flow control ball positioned within the chamber; and a flow control seating at a downhole end of the chamber, the flow control seating including a circular opening with a smaller diameter than a diameter of the flow control ball; and a barrier at an uphole end of the chamber, the barrier having a structure that allows for passage of fluid but restricts passage of the flow control ball.

4. The check valve of claim 3, where a distance between the barrier and the flow control seating is greater than the diameter of the flow control ball.

5. The check valve of claim 3, wherein the diameter of the flow control ball is less than an internal diameter of the chamber.

6. The check valve of claim 1, further comprising a thrust bearing that absorbs a thrust load during operation of the check valve.

7. The check valve of claim 1, further comprising a radial bearing that absorbs a radial load during operation of the check valve.

8. The check valve of claim 1, further comprising a third coupling mechanism, the third coupling mechanism being a rotational coupling mechanism for coupling the check valve to an uphole rotational shaft.

9. The check valve of claim 8, wherein the third coupling mechanism includes splines that match to complementing splines of the uphole rotational shaft.

10. A debris collection tool, comprising:

a motor rotationally coupled to a first end of a pump by a first shaft;

a gearbox rotationally coupled to a second end of the pump by a second shaft; and a check valve rotationally coupled to the gearbox by a third shaft;

a milling bit rotationally coupled to the check valve, wherein the check valve comprises:

a first coupling mechanism for coupling the check valve with an uphole bailer;

a torque transfer mechanism that applies rotational torque to the milling bit, wherein the torque transfer mechanism includes a geometric protrusion with more than two sides, the milling bit includes a cavity that matches the geometric protrusion such that the geometric protrusion can be seated in the cavity and rotation of the check valve causes the milling bit to rotate;

a second coupling mechanism for coupling the check valve with the milling bit;

a lumen extending an axial length of the check valve; and a unidirectional flow control mechanism within the lumen that restricts fluid flow to an uphole direction.

11. The debris collection tool of claim 10, wherein the unidirectional flow control mechanism comprises:

a chamber positioned within the lumen;

a flow control ball positioned within the chamber; and a flow control seating at a downhole end of the chamber, the flow control seating including a circular opening with a smaller diameter than a diameter of the flow control ball; and a barrier at an uphole end of the chamber, the barrier having a structure that allows for passage of fluid but restricts passage of the flow control ball.

12. The debris collection tool of claim 11, the check valve further comprising a third coupling mechanism that rotationally couples the check calve with the third shaft.

13. The debris collection tool of claim 12, wherein the third coupling mechanism and the third shaft include complementing splines that are engaged with each other.

14. The debris collection tool of claim 10, wherein the gearbox is configured to modify rotational speed and torque generated by the motor so that, when activated, the motor drives the pump at a first rotational speed and first rotational torque and drives the check valve at a second rotational speed and second rotational torque.

15. The debris collection tool of claim 10, wherein the pump is a centrifugal pump.

16. The debris collection tool of claim 10, wherein the bailer is positioned between the gearbox and the check valve, and the third shaft passes through the bailer.

17. The debris collection tool of claim 10, wherein the check valve is coupled to the bailer with a coupling mechanism that allows the coupling mechanism to rotate relative to the bailer.

* * * * *